US007494026B2

(12) United States Patent
Bard et al.

(10) Patent No.: US 7,494,026 B2
(45) Date of Patent: Feb. 24, 2009

(54) DESK TOP STOP-A-SPILL QUICK-RELEASE DRINK CONTAINER HOLDER

(76) Inventors: Robert Alan Bard, 180 Marina Blvd., Loveladies, NJ (US) 08008; Douglas Aaron Bard, 180 Marina Blvd., Loveladies, NJ (US) 08008

( * ) Notice: Subject to any disclaimer, the term of this patent is extended or adjusted under 35 U.S.C. 154(b) by 495 days.

(21) Appl. No.: 11/364,652

(22) Filed: Feb. 28, 2006

(65) Prior Publication Data

US 2007/0199946 A1 Aug. 30, 2007

(51) Int. Cl.
*B65D 25/00* (2006.01)

(52) U.S. Cl. ..... 220/737; 220/742

(58) Field of Classification Search ..... 220/737, 220/742, 743; 248/311.2, 316.2, 316.3, 316.5
See application file for complete search history.

(56) References Cited

U.S. PATENT DOCUMENTS 4,693,440 A * 9/1987 Lalonde ..... 248/154
5,713,112 A * 2/1998 Genero et al. ..... 24/490
6,969,035 B2 * 11/2005 Leopold et al. ..... 248/311.2

* cited by examiner

*Primary Examiner*—Anthony D Stashick
*Assistant Examiner*—Harry A Grosso

(57) ABSTRACT

An apparatus for securing various sized drinking containers (cups, mugs, glasses etc.) thus helping to prevent the spilling of liquid drinks from various sized drinking containers onto a desk (or table) top or desk (or table) top protector surface area. The apparatus itself can be placed or even secured anywhere on the desk (or table) top or desk (or table) top protector surface area so that the drinking container can be placed for easy access. More specifically, when the apparatus is employed to secure the drinking container, the stability of the drinking container, with or without its contents, is increased as follows; the apparatus extends the distance from the center of gravity of the secured drinking container and its contents further outward to the outboard edge of the apparatus and even further when the apparatus itself is secured to the desk (or table) top.

1 Claim, 4 Drawing Sheets

DESK TOP STOP-A-SPILL QUICK-RELEASE DRINK CONTAINER HOLDER

BRIEF SUMMARY OF THE INVENTION

It is an object of the present invention to provide a new apparatus for securing various sized drinking containers thus helping to prevent the spilling of drinks onto a desk (or table) top or desk (or table) top protector surface area. The apparatus itself can be placed or even secured anywhere on the desk (or table) top or desk (or table) top protector surface area so that the drink container can be placed for easy access. More specifically, when the apparatus is employed to secure the drinking container, the stability of the drinking container, with or without its contents, is increased as follows; the apparatus extends the distance from the center of gravity of the secured drinking container and its contents further outward to the outboard edge of the apparatus and even further when the apparatus itself is secured to the desk (or table) top or the desk (or table) top protector. More generically, the apparatus will function with various sized containers which hold liquids or any other type of contents.

DETAILED DESCRIPTION OF THE INVENTION

Figure 1:
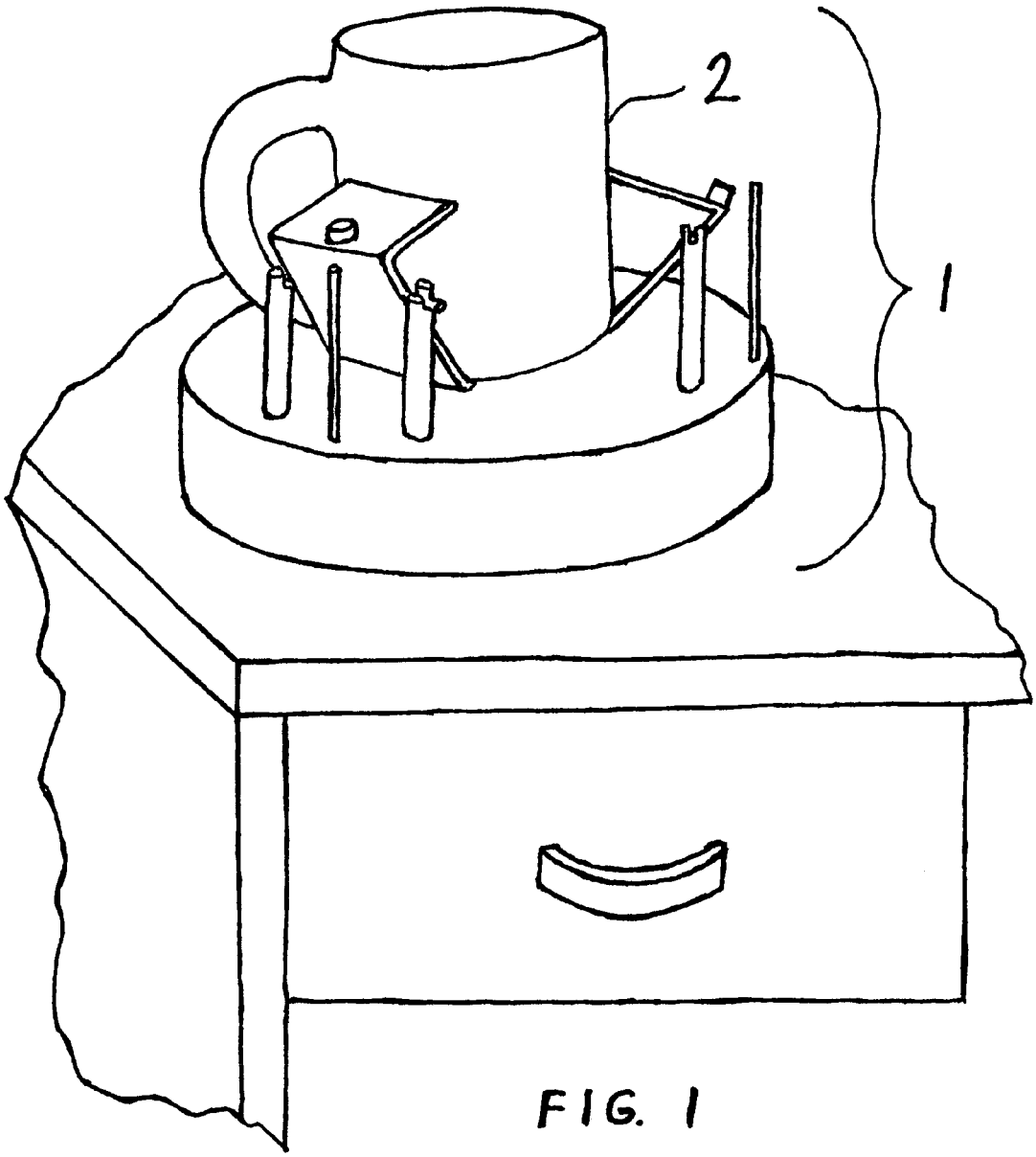
FIG. 1 is a view of the apparatus installed on the left side of the desk (or table) with a drinking container installed in the apparatus.

The preceding features and advantages of the present invention will become apparent with reference to the following detailed description taken in conjunction with the accompanying drawings in which:

FIG. 1 is a view of a portion of the left side of the desk (or table) with the apparatus 1 mounted on the upper surface of the desk (or table) top with a drinking container 2 installed in the apparatus 1. The apparatus 1 is designed to be installed anywhere on the upper surface of the desk (or table) top or on the upper surface of a desk (or table) top protector.

Figure 2:
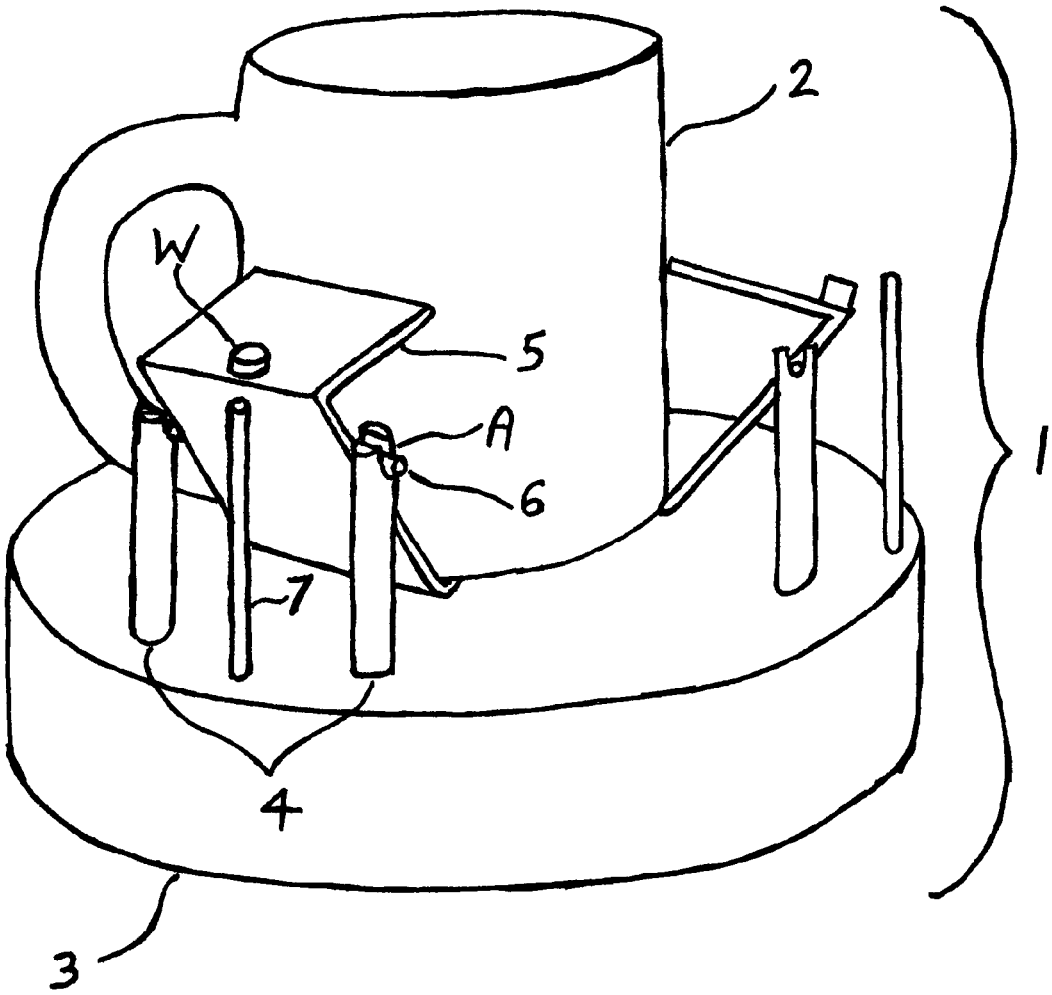
FIG. 2 is an enlarged view of only the apparatus with the drinking container installed in the apparatus.

FIG. 2 is an enlarged view of only the apparatus 1 with the drinking container 2 installed. The apparatus 1 is composed of the following: A rigid base 3 which by virtue of its weight (ballast) alone is able to hold its position once placed on the top of the desk (or table) top or its desk (or table) top protector and which may also be additionally secured to the top of the desk (or table) itself or its desk (or table) top protector via an attachment type substance such as double sided tape, glue, suction device etc. The rigid base 3 serves as a mounting platform for three sets of dual vertical stanchion assemblies 4 each set of which are positioned 120° apart with each individual vertical stanchion 4 being grooved/slotted A at its top to support a pivoted lever arm 5 via the pivot pins 6 that perpendicularly protrude from each side of the pivoted lever arm 5. The foregoing configuration allows the pivoted lever arm 5 to rotate about the singular/common axis of the pivot pins 6. The rotation is stopped either by the outside wall of the drinking container 2 thus clamping on the drinking container 2 or by the outboard rotational stop 7. Because the three sets of dual vertical stanchion assemblies 4 are positioned 120° apart, FIG. 2 only shows two of the three sets of dual vertical stanchion assemblies 4. As detailed later, it is the variable clamping action of the pivoted lever arms 5 which laterally hold variably sized drinking containers 2 in place.

Figure 3:
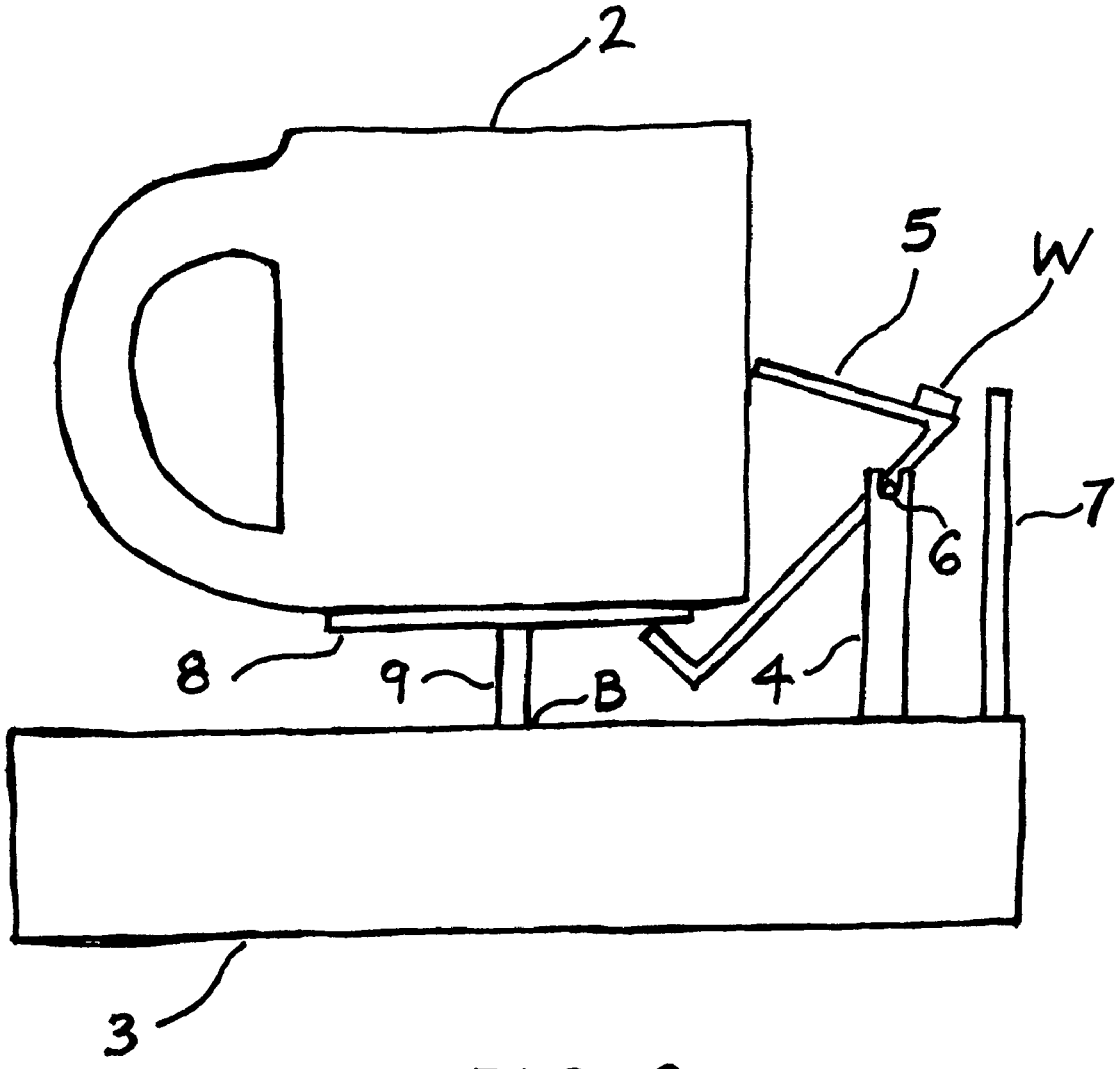
FIG. 3 is an exploded view of a portion of the apparatus's base, one of the three dual vertical stanchion assemblies, its associated pivoted lever arm, the associated rotation stop for the pivoted lever arm, the movable platform and the installed drinking container.

FIG. 3 is an exploded side view of the rigid base 3, one of the sets of dual vertical stanchion assemblies 4, its associated pivoted lever arm 5, its pivot pin 6 and its associated rotational stop 7 along with the movable platform 8 that rides on the lower ends of the three pivoted lever arms 5. The movable platform 8 immediately supports the drinking container 2 which when installed, always has its bottom placed on the top of the movable platform 8 insuring that the plane of the bottom of the drinking container 2 will always be parallel with the upper plane of the rigid base 3 by virtue of the rod 9 which is perpendicularly attached to the center underside of the movable platform 8 and which rides in a hole B which is perpendicularly drilled through the center of the rigid base 3 and which extends through the entire rigid base 3. The periphery of the movable platform 8 can be most any shape (circular, square, triangular) without changing its function/performance. The top surface of the movable platform 8 is "relatively smooth" and "non-stick" via coating materials such as silicone, etc., to allow the three pivoted lever arms 5 which are positioned 120° apart to insure that the drinking container 2 will be shifted towards the center of the movable platform 8 even if the drinking container 2 is not initially placed at the center of the movable platform 8. It should be noted that by virtue of the way each pivoted lever arm 5 is counter balanced via weight W, the upper end of each of the three pivoted lever arms 5 initially rest against their associated rotation stop 7 before the upper end of each pivoted lever arm 5 is caused to rotate towards the drinking container 2 via the force put on the lower end of the pivoted lever arm 5 by the movable platform 8 when the movable platform 8 is moved down by the weight of the drinking container 2, with or without its contents. More generically, the apparatus 1 will properly function when it consists of any plurality of dual sets of stanchion assemblies 4 and their associated pivoted lever arms 5 configured to provide a minimum of a three point contact of the upper end of the pivoted lever arm 5 with the outside of the drinking container 2 for the dual purpose of acting to center the drinking container 2 on the movable platform 8 even when the drinking container 2 is not initially placed at the center of the movable platform 8 as well as for laterally securing/constraining the drinking container 2.

Figure 4:
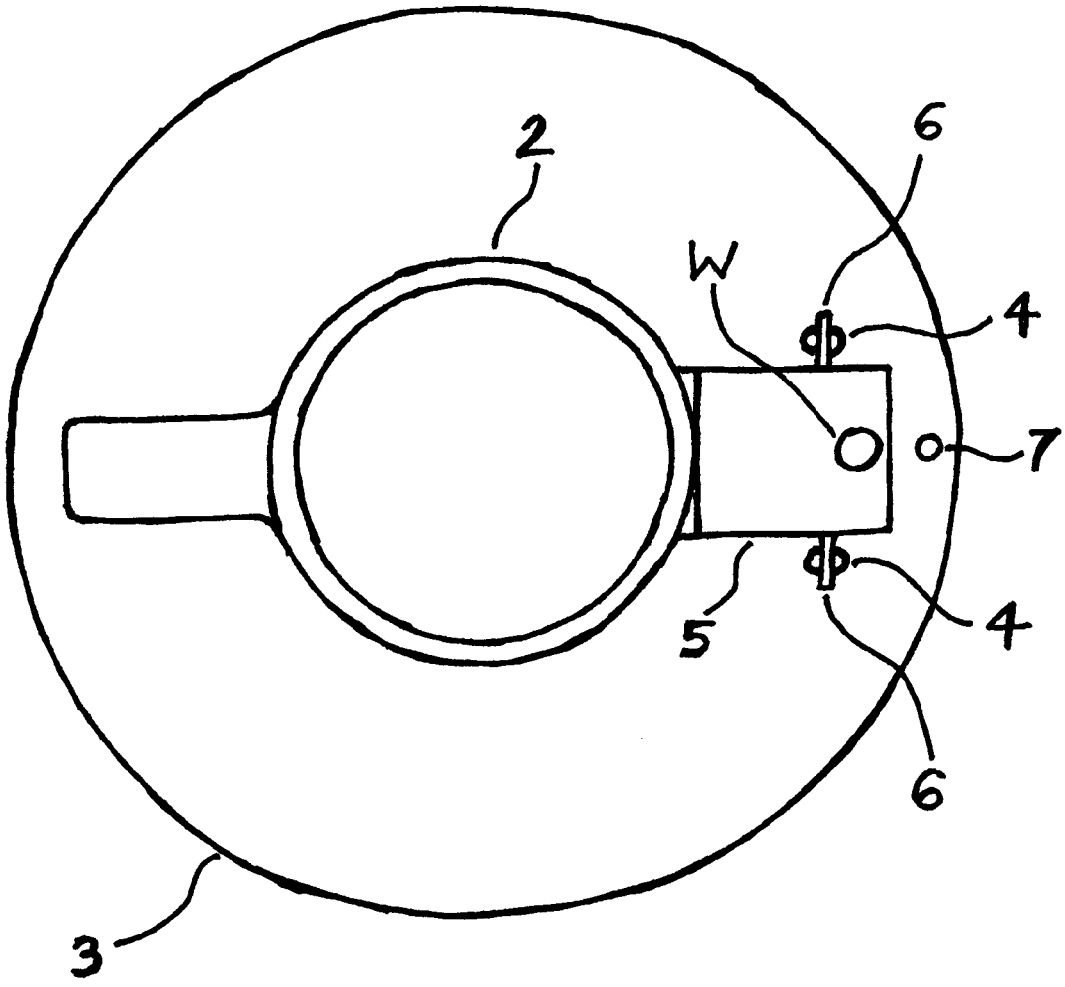
FIG. 4 is a top view of FIG. 3.

FIG. 4 shows a top view of the items in FIG. 3. The major purpose of this FIG. 4 is to show the full length view of the two pivot pins 6 as well as the full width view of the pivoted lever arms 5 with its counter balancing weight W. Also shown in this FIG. 4 is the top view of the drinking container 2, one of the sets of dual vertical stanchion assemblies 4, the associated rotational stop 7 and the rigid base 3. The movable platform 8 is obviously hidden from view in this FIG. 4.

What we claim our invention is:

1. A device for releasably holding a cup of tea or bottle of soda or like refreshment comprising (a) a base;

(b) a movable platform which moves up and down relative to the base via a rod which is perpendicularly attached to the center under side of the moveable platform and which slides in a hole which is located at the center of the base and has its axis perpendicular to both the upper and lower parallel flat surfaces of the base;

(c) three single jaw members such that each single jaw member is pivotally carried between each of three sets of dual vertical stanchions which are located 120 degrees apart, are peripheral to the moveable platform, are carried by said base and are projecting upward therefrom such that, (d) the lower end of each single jaw member rides constrained against the underside of the movable platform as the movable platform moves down or up as a function of the refreshment beverage container being placed on or removed from the movable platform, the free upper end of each jaw member is pivotable toward and away from the center of gravity of the device to respectively grasp and release a beverage refreshment container therebetween, said pivot mounting of each single jaw member being so located relative to the center of gravity of each single jaw member that each single jaw member is biased to an open position when the refreshment beverage container is removed from the movable platform and closed against the refreshment beverage container when the refreshment beverage container moves the movable platform downward and (e) three rotation stops, each of which are carried by said base, are projecting upward therefrom and are located outboard of each of the three sets of stanchions as well as outboard of each of the three single jaw members to prevent the free upper end of each of the three jaw members from rotating outward from the center of gravity of the device to the extent that the rod would be lifted completely out of its mating hole in the base.

* * * * *